US006699083B2

(12) United States Patent
Rinzaki et al.

(10) Patent No.: US 6,699,083 B2
(45) Date of Patent: Mar. 2, 2004

(54) ENGINE COVER ARRANGEMENT FOR AN OUTBOARD MARINE DRIVE

(75) Inventors: Shoichi Rinzaki, Tokyo (JP); Hideki Nemoto, Tokyo (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/072,439

(22) Filed: Feb. 5, 2002

(65) Prior Publication Data

US 2002/0111085 A1 Aug. 15, 2002

(30) Foreign Application Priority Data

Feb. 13, 2001 (JP) ..... 2001-035479

(51) Int. Cl.[7] ..... B63H 20/32
(52) U.S. Cl. ..... 440/77
(58) Field of Search ..... 440/76, 77; 123/195 C, 123/198 E; 277/641, 645

(56) References Cited

U.S. PATENT DOCUMENTS 4,617,220 A * 10/1986 Ginster ..... 428/122
4,930,790 A * 6/1990 Sheridan ..... 277/630
5,025,763 A * 6/1991 Watanabe ..... 123/198 E
5,052,353 A * 10/1991 Dunham et al. ..... 123/195 P
5,096,208 A * 3/1992 Westberg ..... 277/641
5,135,239 A * 8/1992 Kato et al. ..... 277/645
5,803,777 A * 9/1998 Hiraoka ..... 440/77
6,190,219 B1 * 2/2001 Meier et al. ..... 440/77

FOREIGN PATENT DOCUMENTS

JP 2-292575 12/1990

* cited by examiner

*Primary Examiner*—S. Joseph Morano
*Assistant Examiner*—Andrew Wright
(74) *Attorney, Agent, or Firm*—MacPherson Kwok Chen & Heid LLP

(57) ABSTRACT

In an outboard marine drive, an engine is supported on an engine mount case, and an under cover made of plastic material having a lower end attached to the engine mount case defines an open upper end which engages an open lower end of an engine cover also made of plastic material. A metallic stay member having a lower end fixedly attached to the engine mount case which is typically made of cast aluminum alloy and an upper end fixedly supporting a support rail reinforces the open upper end of the under cover. Thus, the essential part is reinforced by a metallic member, and the required mechanical strength can be achieved while minimizing the increase in weight. The upper end of the stay member may be used for attaching a latch unit for securing the engine cover to the under cover or the engine mount case.

13 Claims, 9 Drawing Sheets

ENGINE COVER ARRANGEMENT FOR AN OUTBOARD MARINE DRIVE

TECHNICAL FIELD

The present invention relates to an outboard marine drive, and in particular to an engine cover arrangement for an outboard marine drive including an under cover covering a lower part of the engine and defining an upper opening, and an engine cover having a lower opening which closes upon the upper opening of the engine cover via a seal member for jointly defining an engine room.

BACKGROUND OF THE INVENTION

A relatively large outboard marine drive typically comprises an engine mount case supporting the engine, an under cover attached to the engine mount case to cover a lower part of the engine, and an engine cover having the shape of a deep bowl covering an upper part of the engine. An open upper end of the under cover and an open lower end of the engine cover are joined to each other via a seal member in a detachable manner by means of latch units provided between the under cover and engine cover. The seal member keeps moisture out of the engine room.

The seal member closely engages the interfaces of the under cover and engine cover by being compressed between them under a certain load. If this compressive load is too large, an unacceptably large force is required to latch the engine cover onto the under cover. If the compressive load is too small, the required sealing performance may not be achieved. To meet such a requirement, a seal member including a hollow cross section is proposed, for instance in Japanese patent laid open publication No. 2-292575.

The seal member based on this proposal provides a favorable resiliency which achieves a required performance with a relatively small compressive reaction. However, it still relies on the resiliency of the seal member for the compressive reaction which cooperates with the latch units, and the sealing performance tends to be lost as the seal member has been used for an extended period of time and a substantial part of its resiliency has been lost. To compensate for this problem, lip seals are additionally provided to the seal member. However, the direction of the reaction force is still the same between the hollow part and lip seals, and a sealing performance cannot be maintained once the material of the seal member loses most of its resiliency even with the addition of such lip seals.

BRIEF SUMMARY OF THE INVENTION

In view of such problems of the prior art, a primary object of the present invention is to provide an engine cover arrangement for an outboard marine drive which can provide a favorable sealing performance for an entire service life of the outboard marine drive.

A second object of the present invention is to provide an engine cover arrangement for an outboard marine drive in which the seal member is not directly subjected to the pressure from the latch units or other closure elements.

A third object of the present invention is to provide an engine cover arrangement for an outboard marine drive which does not rely on the resiliency of the seal member for the reaction force of the latch units.

According to the present invention, these objects can be accomplished by providing an engine cover arrangement for an outboard marine drive, comprising: a first cover covering a part of an internal combustion engine and provided with a first opening; a second cover covering a remaining part of the engine and provide with a second opening adapted to be fit onto the first opening, the second cover being provided with a first seal surface extending substantially in parallel with a plane defined by the first and second openings along a peripheral part of the second opening and a second seal surface extending substantially perpendicularly with respect to the first seal surface from an inner periphery of the first seal surface toward the first cover; and a seal member attached along a peripheral part of the first opening of the first cover and adapted to engage both the first and second seal surfaces of the second cover. Typically, the seal member comprises a retaining portion attached to an edge of the first cover, and an engagement portion extending from the retaining portion. In particular, in a larger outboard marine drive, the engine itself is typically mounted on an engine mount case made of metallic member, and the second cover consists of an under cover fixedly attached to the engine mount case while the first cover consists of an engine cover. The under cover and engine cover are typically made of plastic material.

Because the seal member attached along a peripheral part of the first opening of the first cover is adapted to engage not only a first sealing surface perpendicular to the closing direction of the two covers but also a second sealing surface substantially in parallel with the closing direction of the two covers, the seal member is not required to rely on the pressure directed in the closing/opening direction of the two covers, and is prevented from being excessively compressed. Also, by providing a separate stopper arrangement for defining the closed position of the two covers, the seal member is additionally protected from excessive compression.

According to a preferred embodiment of the present invention, the seal member includes a first lip portion engaging the first seal surface and a second lip portion engaging the second seal surface. The lip portions provide a favorably sealing performance without much relying on the pressure acting thereof. The first lip portion is provided in the engagement portion, but the second lip portion may be provided either in the retaining portion or the engagement portion.

According to a particularly preferred embodiment of the present invention, the seal member comprises a first lip portion provided in the engagement portion to engage the first seal surface, a second lip portion provided in the retaining portion to engage the second seal surface, and a third lip portion which extends from the retaining portion next to the first lip portion to engage the second seal surface by being pressed by the first lip portion as the first lip portion engages the first seal surface and deforms inward as a result. The third lip portion may also additionally engage the first seal surface.

Preferably, to enhance such an action of the first lip portion on the third lip portion, the third lip portion may be provided with a cross section having the shape of a laterally facing letter-V or chevron with a concave side facing the first lip portion, and the first lip portion may be provided with an arcuate cross section with a concave surface facing the third lip portion.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
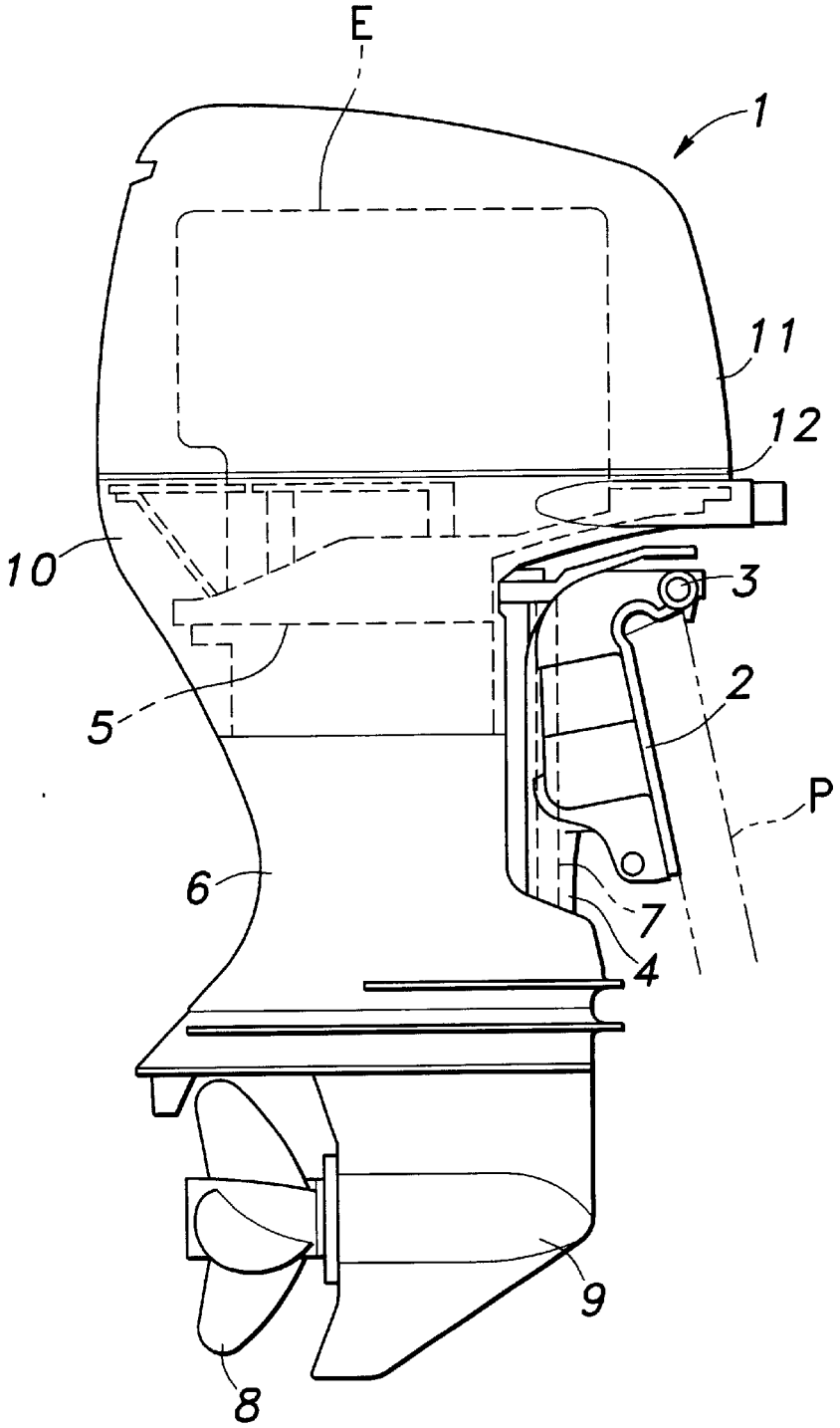
FIG. 1 is an external side view of an outboard marine drive embodying the present invention.

FIG. 1 is a side view showing the entire outboard marine drive embodying the present invention. This outboard marine drive 1 is adapted to be attached to the stern board P of a boat via a stern bracket 2.

To the stern bracket 2 is connected a swivel case 4 so as to be rotatable around a laterally extending tilt shaft 3. The swivel case 4 has an upper end which pivotally supports a front end of an engine mount case 5 and a lower end which pivotally supports an extension case 6 accommodating a part of a power transmission unit such as a drive shaft, so as to be rotatable around a vertically extending swivel shaft 7 in each case.

The upper end of the extension case 6 is connected to the engine mount case 5, and the lower end of the extension case 6 is connected to a gear case 9 supporting a propeller 8. The engine mount case 5 is covered by an under cover 10, and the upper end of the under cover 10 is fitted with an engine cover 11 defining a deep bowl shape having a lower open end in a detachable manner so as to cover, primarily, the upper part of the engine E which is mounted on the engine mount case 5. The engine E in this embodiment consists of a four-stroke V-type vertical engine.

A seal member 12 made of rubber or other elastomer material is interposed between the open ends of the under cover 10 and engine cover 11 to seal off water at the interface between the under cover 10 and engine cover 11, and the two parts are retained to each other by a latching arrangement (which is described hereinafter) provided adjacent to the interface between the two parts.

Figure 2:
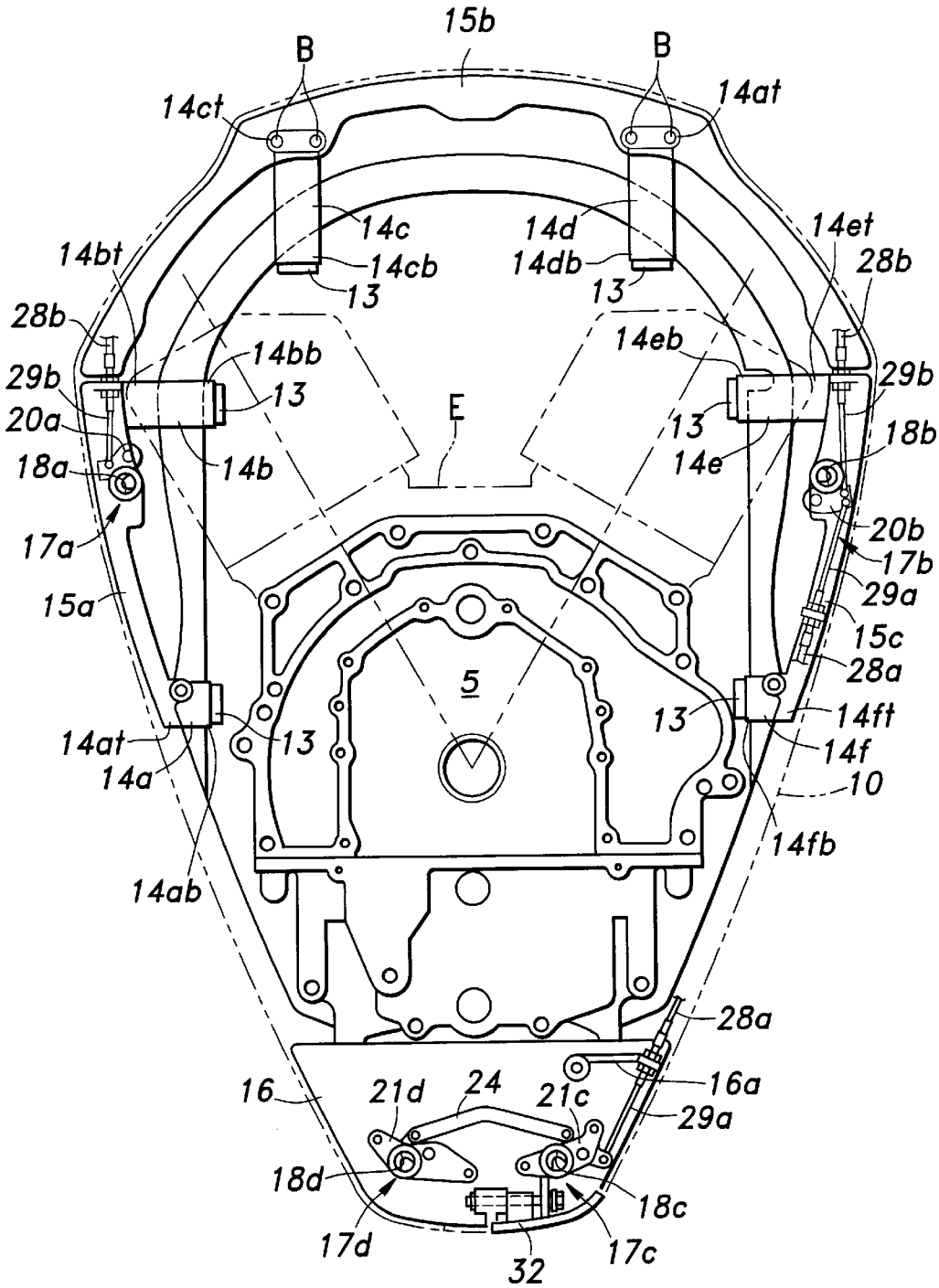
FIG. 2 is a simplified top view of the engine mount case revealing the mounting surface for the engine cover.
Figure 3:
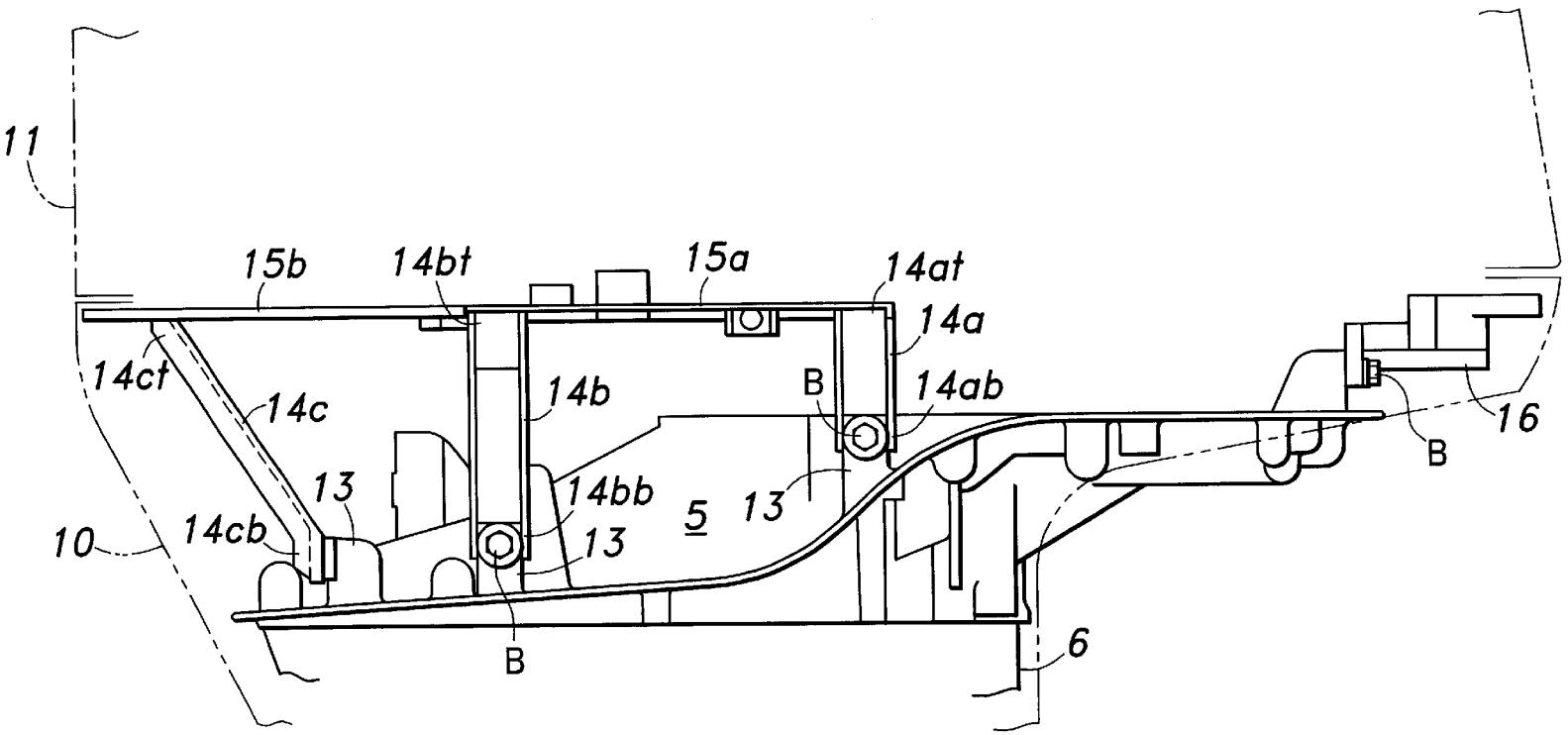
FIG. 3 is a simplified left side view of the mounting portions of the under cover and engine cover.

FIG. 2 is a top view of the outboard marine drive 1 of the present invention revealing the end surface for mounting the engine cover, and FIG. 3 is a left side view of the same. The orientation of the outboard marine drive is defined such that the lower end of FIG. 2 corresponds to the front. Referring to FIGS. 2 and 3, the engine mount case 5 made of die cast aluminum alloy is provided with six bosses 13 in an outer periphery of a rear part thereof, and the lower ends 14*ab* to 14*fb* of six upright stay members 14*a* to 14*f* made of metallic material such as steel are attached to the corresponding bosses 13 by using threaded bolts B each extending in a horizontal direction. The upper ends 14*at* to 14*ft* of these stay members 14*a* to 14*f* fixedly support under cover support rails 15*a* to 15*c*.

The under cover support rails 15*a* to 15*c* consist of three parts which are made of metallic material such as stamp formed steel members. The side parts 15*a* and 15*c* located on either side of the engine cover are integrally formed with side stay members 14*a* and 14*b*; and 14*e* and 14*f* in such a manner as to join the upper ends 14*at* and 14*bt*; and 14*et* and 14*ft* of the two side stay members 14*a* and 14*b*; and 14*e* and 14*f* to each other which are fixedly attached to either side of the engine mount case 5. The arch shaped rear part 15*b* is fixedly attached to the upper ends 14*ct* and 14*dt* of the two rear stay members 14*c* and 14*d* with threaded bolts B. The front part of the engine mount case 5 is provided with a front bracket 16 for supporting the under cover 10. The front bracket 16 is cast separately from the engine mount case 5 and fixedly attached to the front end of the engine mount case 5 with threaded bolts B. The right and left under cover support rails 15*a* and 15*c* are provided with an adequate mechanical strength to support the weight of the outboard marine drive 1 when it is placed on its side.

The under cover 10 whose upper open end is supported by these under cover support rails 15*a* to 15*c* is made of plastic material, and surrounds the lower part of the engine E and the part of the extension case 6 connected to the engine mount case 5. In the illustrated embodiments, the support rails 15*a* to 15*c* as well as the stay members 14*a* to 14*f* are made of metallic material, but may be made of plastic or other reinforced or non-reinforced materials that are provided with an adequate mechanical strength.

As components of the latching arrangement R for attaching the engine cover 11 made of plastic material to the upper open end of the under cover 10 which is also made of plastic material, four latch units 17*a* to 17*d* are provided, one on each of the side under cover support rails 15*a* and 15*c* connecting the side stay members 14*a* and 14*b*; and 14*e* and 14*f* of the corresponding side to each other, and two on the front bracket 16. By thus providing the latch units 17*a* to 17*d* forming components of the latching arrangement R on members that are made of metallic material, the reliance on the under cover 10 made of plastic material in ensuring the overall mechanical strength can be avoided.

The four latch units 17*a* to 17*d* are arranged in such a manner that the distance between the one 17*d* on the left side of the front bracket 16 and the one 17*a* on the left under cover support rail 15*a* is substantially equal to the distance between the one 17*c* on the right side of the front bracket 16 and the one 17*b* on the right under cover support rail 15*c*, and is also substantially equal to the distance between the ones 17*a* and 17*b* on the right and left under cover support rails 15*a* and 15*c*, respectively. By thus arranging the latching positions in an equilateral or isosceles triangular arrangement, two in the front as a single group and two on either side, the retaining force acting between the under cover 10 and the engine cover 11 can be made substantially uniform over the entire circumference.

Figure 4:
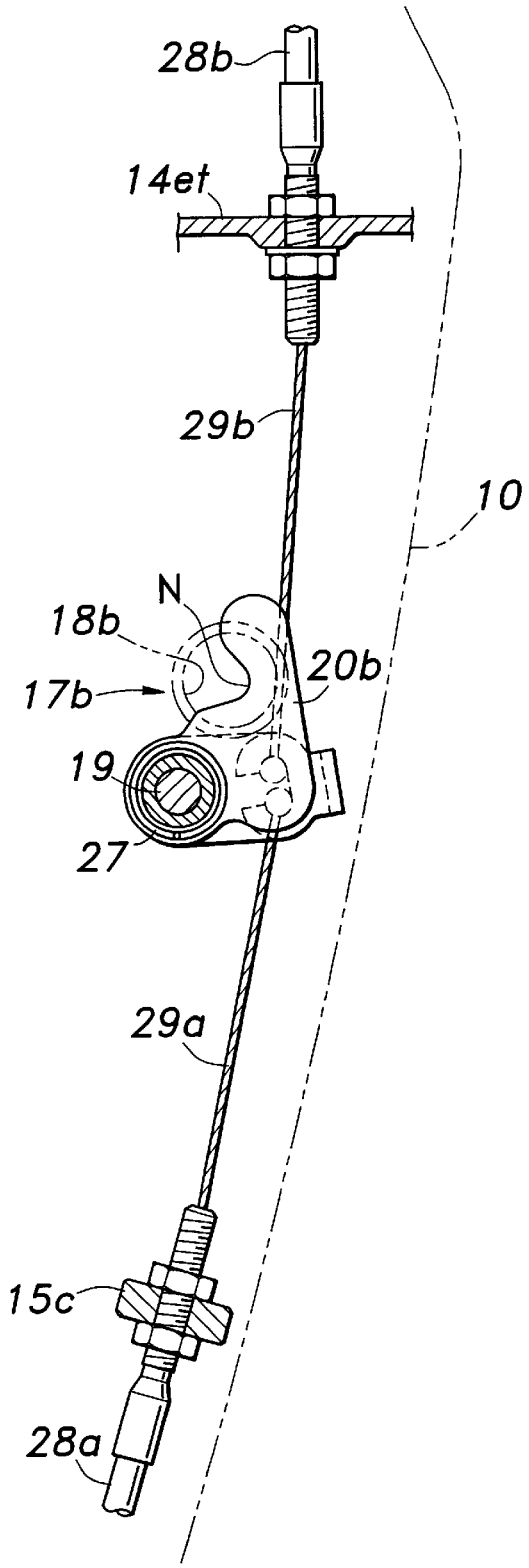
FIG. 4 is a top view of the rear latch unit.
Figure 5:
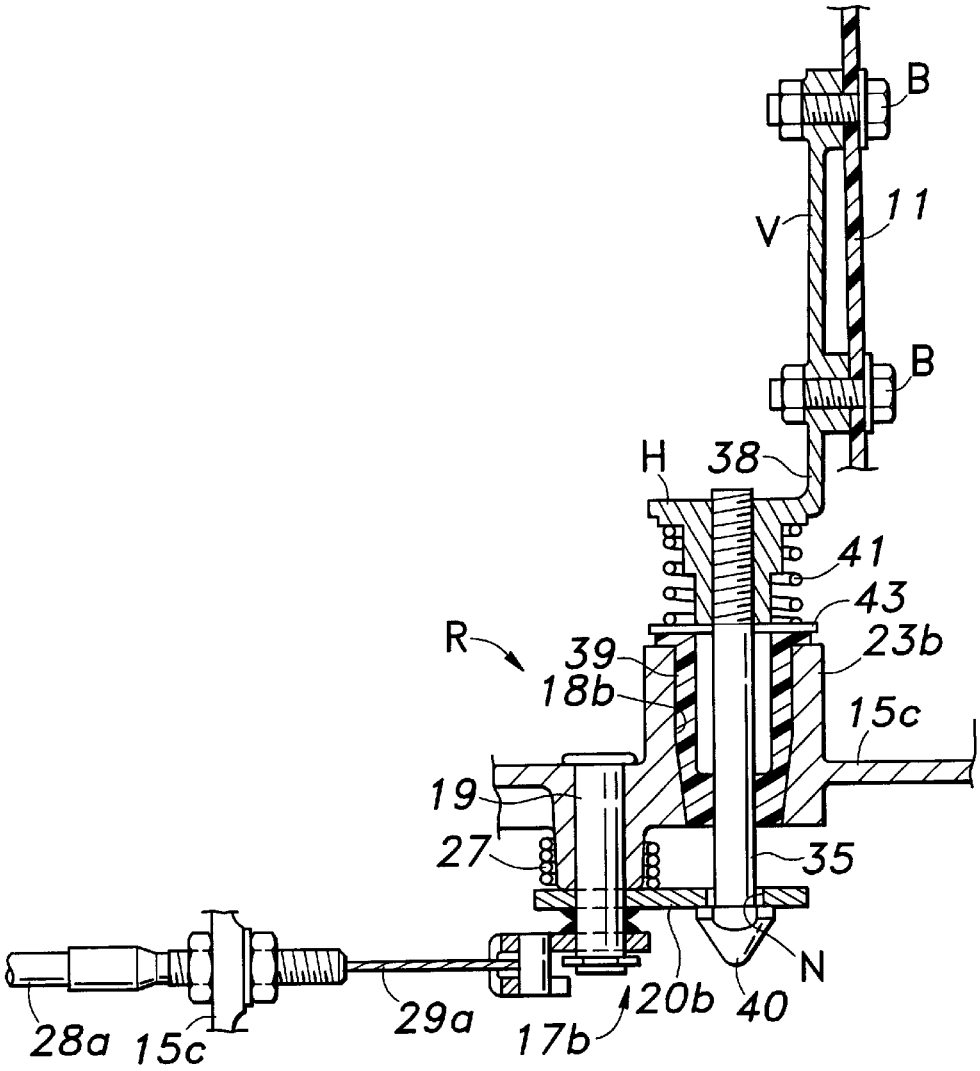
FIG. 5 is a vertical sectional view of the rear latch unit.

As shown in FIGS. 4 and 5, of these four latch units 17*a* to 17*d*, the ones 17*a* and 17*b* on either side each consist of a vertical hole 18*a* and 18*b* passed in a cylindrical collar 23*a* and 23*b* integrally formed in the corresponding under cover support rail 15*a* and 15*c*, and a latch plate 20*a* and 20*b* which is pivotally supported adjacent to the corresponding hole 18*a* and 18*b* by a vertical shaft 19 so as to be rotatable in a horizontal plane between a position interfering with the corresponding hole 18*a* and 18*b* and a position not interfering with the corresponding hole 18*a* and 18*b*. FIGS. 4 and 5 show only the right latch unit 17*b*, and the left latch unit 17*a* is identical to the right latch unit 17*b* except that they are mirror images of each other.

Figure 6:
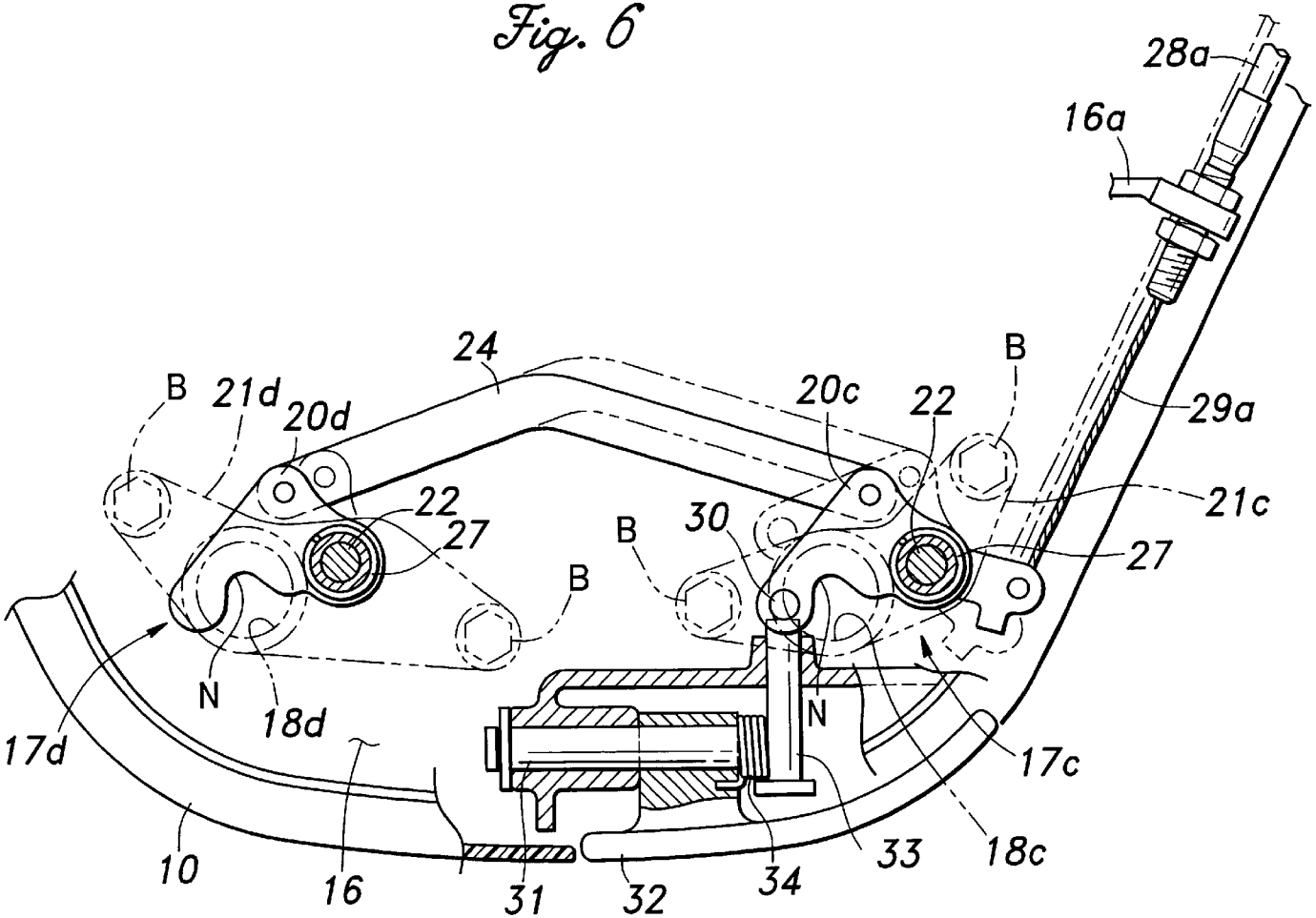
FIG. 6 is a top view of the front latch unit.
Figure 7:
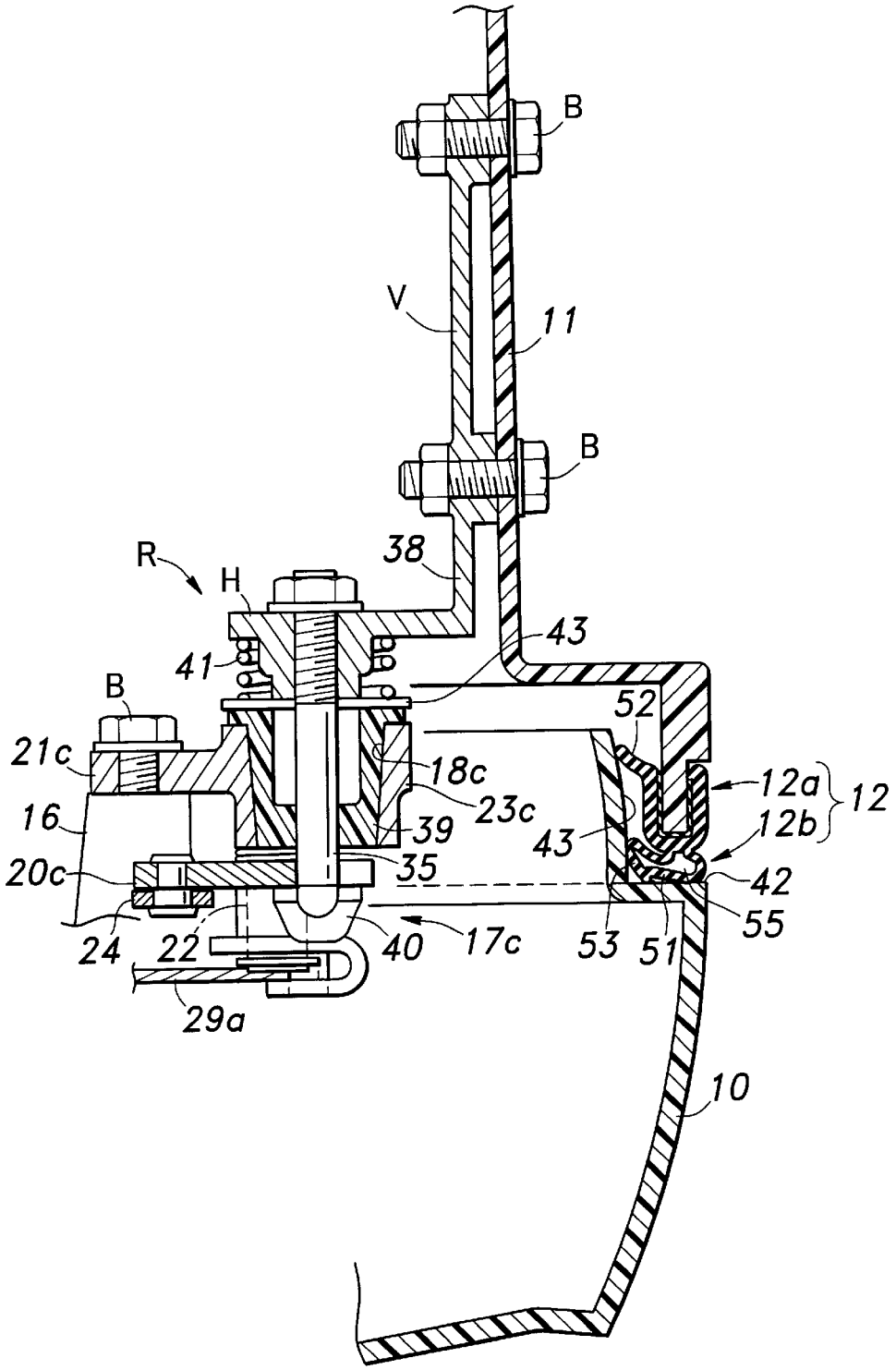
FIG. 7 is a vertical sectional view of the front latch unit.

As shown in FIGS. 6 and 7, the two front latch units 17*d* and 17*c* comprise a pair of holder members 21*d* and 21*c* each fixedly attached to the upper surface of the front bracket 16 with a pair of threaded bolts B, right and left latch plates 20*d* and 20*c* which are each pivotally supported by the corresponding holder member 21*d* and 21*c* with a vertical shaft 22, and a link member 24 made of steel plate punched out into a shape of a rod bent in the middle as seen from above and joining the right and left latch plates 20*d* and 20*c* with each other. Thus, the two latch units 17 *d* and 17*c* form a single sub assembly by being connected to each other by the rigid link member 24.

A vertical hole 18*d* and 18*c* is formed a collar 23*d* and 23*c* integrally formed in each of the holder members 21*d* and 21*c* between the two fastening bolts B, and each latch plate 20*d* and 20*c* is pivotally supported adjacent to the corresponding hole 18*d* and 18*c* so as to be rotatable in a horizontal plane between a position interfering with the corresponding hole 18*d* and 18*c* and a position not interfering with the corresponding hole 18*d* and 18*c*.

Each of the four latch plates 20*a* to 20*d* mentioned above is resiliently urged by a torsion coil spring 27 so as to retain corresponding latch plate 20*a* to 20*d* in the position interfering with the corresponding hole 18*a* to 18*d* as long as no external force is applied thereto. Each of the latch plates 20*a* to 20*d* is provided with a notch N at a position corresponding to the center of the corresponding hole 18*a* to 18*d*.

The right front latch plate 20*c* on the front bracket 16 is provided with a connecting end for the inner cable 29*a* of a first Bowden cable 28*a* at one end thereof, and a pin 30 for engaging a push rod (which is described hereinafter) at the other end thereof, on either side of the vertical shaft 22.

Figure 8:
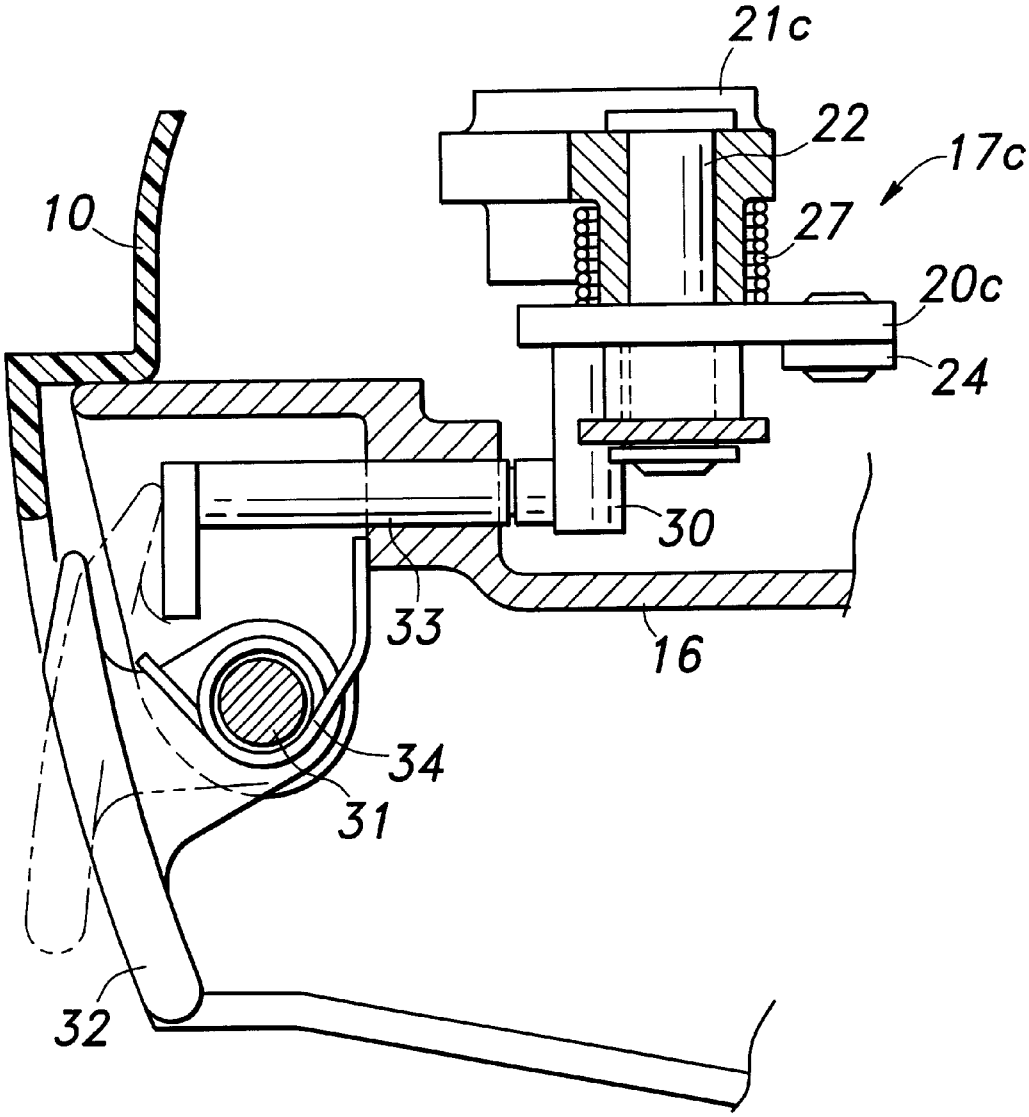
FIG. 8 is a vertical sectional view of the latch release mechanism.

As also shown in FIG. 8, the front end of the front bracket 16 is provided with a latch release lever 32 pivotally supported by a horizontal shaft 31, and a push rod 33 that can slide in the fore-and-aft direction. The latch release lever 32 has an upper end that can engage the front end of the push rod 33, and is normally urged by a torsion coil spring 34 in the direction to prevent the upper end of the latch release lever 32 from engaging the front end of the push rod 33 or away from the front end of the push rod 33.

When the latch release lever 32 is turned around the horizontal shaft 31 by pulling the lower end of the lock release lever 32 outward, the upper end thereof pushes the push rod 33 rearward. As a result, the pin 30 extending upright from the left end of the front right latch plate 20*c* is pushed rearward, causing the latch plate 20*c* to rotate around the vertical shaft pin 22. This in turn causes the left end of the latch plate 20*c* provided with the pin 30 to be moved rearward, and the right end thereof to be moved forward. Thus, the inner cable 29*a* of the first Bowden cable 28*a* is pulled outward.

Meanwhile, the rotation of the front right latch plate 20*c* is transmitted to the front left latch plate 20*d* via the link member 24. As a result, the right and left latch plates 20*c* and 20*d* rotate by a same angle. This rotational movement causes the notch N of each latch plate which has been aligned with the center of the corresponding vertical hole 18*d* and 18*c* to be moved away from the corresponding hole 18*d* and 18*c*.

The front right latch plate 20*c* is connected to the rear right latch plate 20*b* of the rear right latch unit 17*b* via the first Bowden cable 28*a*. The rear right latch plate 20*b* is connected to the rear left latch plate 20*a* of the rear left latch unit 17*a* via a second Bowden cable 28*b*. The outer tubes of the first and second Bowden cables 28*a* and 28*b* extending between the three latch plates are attached to a part 16*a* of the front bracket 16, a middle part of the right under cover support rail 15*c*, an upper end 14*et* of the rear right stay member 14*e*, and an upper end 14*bt* of the rear left stay member 14*b* so that the tension of the inner cables 29*a* and 29*b* of the first and second Bowden cables 28*a* and 28*b* may be adjusted independently. Thus, the error in the synchronization between the two latch plates can be minimized. Because the outer tube of a Bowden cable is highly flexible as well known in the art, the latch plates can be arranged at will.

The parts of the inner surface of the engine cover 11 corresponding to the holes 18*a* to 18*d* are provided with striker pins 35 as shown in FIGS. 5 and 7. Each striker pin 35 is attached, by threading, to a horizontal portion H of an L-shaped bracket 38 which is fixedly attached to the inner surface of the circumferential wall of the engine cover 11 at its vertical portion V, and is oriented vertically.

A damper bush 39 consisting of a tubular member made of elastomer and provided with an outer diameter which allows it to be fitted into the corresponding hole 18 is slidably fitted on a stern portion of each striker pin 35 via a washer 43. The free end of each striker pin 35 is integrally provided with a tapered enlarged diameter portion 40. A compression coil spring 41 is interposed between the lower surface of the horizontal portion H of each bracket 38 adjacent to the base end of the corresponding striker pin 35 and the upper surface of the damper bush 39 via the washer 43 to urge them away from each other.

Figure 9:
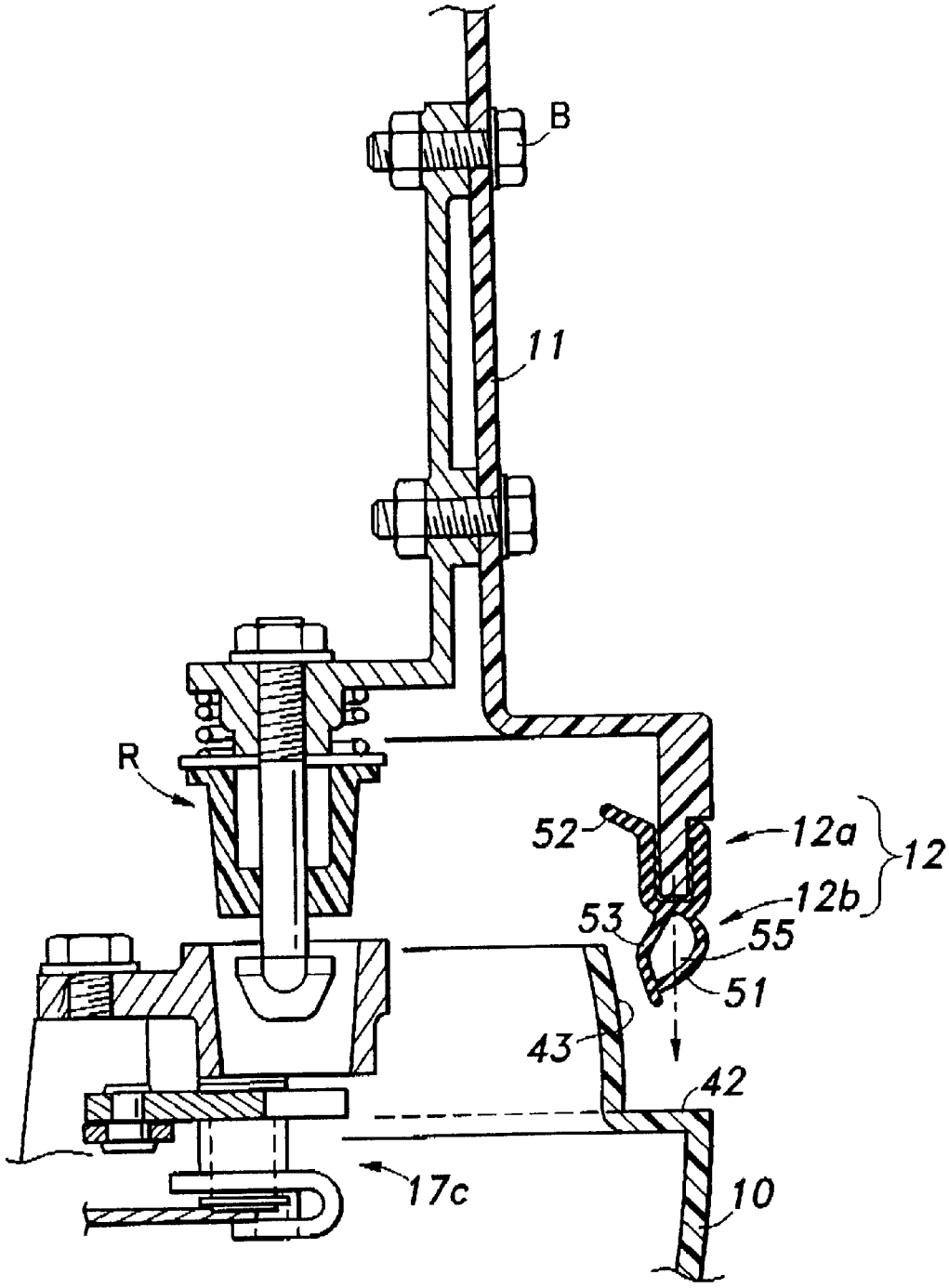
FIG. 9 is a vertical sectional view of the front latch unit when the engine cover is lifted away from the under cover.

Referring to FIG. 9, the seal member 12 comprises a retaining portion 12*a* attached to the lower edge of the engine cover 11, and an engagement portion 12*b* depending from the retaining portion 12*a*. The engagement portion 12*b* includes an outer lip portion 51 and an inner lip portion 53 both depending from the retaining portion 12*a* one next to the other in a parallel relationship. The inner lip portion 53 essentially consists of a linear segment bent in the middle (or in the shape of a laterally directed letter-V or chevron) so as to present a concave surface outward or toward the outer lip portion 51. The outer lip portion 51 has a semicircular cross section with a concave surface thereof facing inward or toward the inner lip portion 53. One of the tip of these two lip portion 51 and 53 preferably abuts a side of the other so that the two lip portions 51 and 53 jointly define a hollow tube-like configuration (the internal hollow space is denoted with numeral 55) over the entire circumference of the interface between the engine cover 11 and under cover 10.

The retaining portion 12*a* has a substantially U-shaped cross section so as to fit onto the lower edge of the engine cover 11 which depends vertically downward. The inner peripheral part of the retaining portion 12*a* is provided with an extension at an upper end thereof in the form of an upper lip portion 52 which is slightly bent inward.

The outer lip portion 51 extends obliquely downwardly and inwardly across a center line of the seal member (indicated by the chain-dot line arrow), and a free end of the outer lip portion 51 abuts an outer side of the inner lip portion 53 which is somewhat offset inwardly with respect to the center line. The under cover is provided with a horizontal seal surface 42 which extends along the outer periphery of the under cover 10 opposite the lower edge of the engine cover 11. A substantially vertical seal surface 43 extends vertically from an inner periphery of the horizontal seat surface 42. In this embodiment, the vertical seal surface 43 is slightly inwardly curved toward its upper part, and therefore presents a convex outer peripheral surface.

The mode of operation of this embodiment is described in the following. When placing the engine cover 11 over the under cover 10, the striker pins 35 are fitted into the corresponding holes 18*a* to 18*d* provided in the under cover 10 while the engine cover 11 is placed over the engine E. When the damper bushes 39 are fitted into the holes 18*a* to

18*d* and the engine cover 11 is pushed further down, the striker pins 35 are lowered against the spring force of the compression coil springs 41. As the enlarged diameter portions 40 of the striker pins 35 reach the notches N of the corresponding latch plates 20*a* to 20*d*, the tapered enlarged diameter portions 40 push away the corresponding latch plates 20*a* to 20*d*. As the enlarged diameter portions 40 pass the corresponding notches N, the latch plates 20*a* to 20*d* are forced back to their original positions by the spring force of the torsion coil springs 27, and the notches N of the latch plates 20*a* to 20*d* engage the enlarged diameter portions 40 of the corresponding striker pins 35 with the result that the engine cover 11 is locked in place.

Meanwhile, the outer lip portion 51 of the engagement portion 12*b* of the seal member 12 engages the first seal surface 42 defined by a horizontal surface in the upper end of the under cover 10. Because the free end of the outer lip portion 51 is offset inward or toward the engine room with respect to the center (indicated by the chain-dot line arrow in FIG. 9) of the load from the engine cover 11, the outer lip portion 51 deforms inward as it is pushed against the horizontal first seal surface 42. The inner lip portion 53 likewise abuts the horizontal seal surface 42 as the engine cover 11 is fully closed, but by being pushed inward by the outer lip portion 51, additionally abuts the vertical seal surface 43 at an intermediate part of the inner lip portion 53. Thus, the outer and inner lip portions 51 and 53 engage the seal surfaces 42 and 43 at three places, and this provides a highly reliable sealing performance. At the same time, the upper lip portion 52 engages the vertical seal surface 43, and this provides an additional assurance for the reliable performance.

In this latched state, because the compression coil springs 41 disposed coaxially with respect to the corresponding striker pins 35 apply a force which urges the under cover 10 and engine cover 11 away from each other, the reaction force acting against the engagement force between the latch plates 20*a* to 20*b* and the striker pins 35 is not required to rely on the restoring force of the seal rubber 12.

During this latching process, when the engine cover 11 is pushed downward onto the under cover 10, the downward movement of the engine cover 11 is limited by the abutment between the horizontal portions H of the brackets 38 and the upper end of the collars 23*a* to 23*b* with the washers 43 and the rubber bushes 39 interposed between them. The rubber bushes 39, in cooperation with the compression coil springs 41, accommodate positional errors that may be present in the latch units, and provide a cushioning effect. Also, this prevents the seal member 12 from being excessively compressed when closing the engine cover 11 onto the under cover 10, and contributes to the elongation of the effective service life of the seal member 12.

When the latch release lever 32 is pulled outward, all of the latch plates 20*a* to 20*d* connected to the link member 24 and the Bowden cables 28*a* and 28*b* rotate in the direction to release the latch plates 20*a* to 20*d*. This causes the enlarged diameter portions 40 of the striker pins 35 to be disengaged from the corresponding notches N, and the engine cover 11 to be pushed upward by virtue of the spring force of the compression coil springs 41 provided on the striker pins 35 which is possibly assisted by the restoring force of the seal member 12. This in turn causes the striker pins 35 to be moved upward, and the enlarged diameter portions 40 to be moved to such positions as to disable the notches N of the corresponding latch plates 20*a* to 20*d* from engaging the striker pins 35. Under this condition, because the latching arrangement R is entirely released, the engine cover 11 can be lifted while the damper bushes 39 are pushed away from the corresponding holes 18*a* to 18*d*.

Thus, according to the present invention described above, because the seal member attached along a peripheral part of the first opening of the first cover is adapted to engage not only a first sealing surface perpendicular to the closing direction of the two covers but also a second sealing surface substantially in parallel with the closing direction of the two covers, the seal member is not required to rely on the pressure directed in the closing/opening direction of the two covers, and is prevented from being excessively compressed. This contributes to the improvement in the reliability of the seal member. Also, by providing a separate stopper arrangement for defining the closed position of the two covers, the seal member is additionally protected from excessive compression.

Although the present invention has been described in terms of a preferred embodiment thereof, it is obvious to a person skilled in the art that various alterations and modifications are possible without departing from the scope of the present invention which is set forth in the appended claims.

What is claimed is:

1. An engine cover arrangement for an outboard marine drive, comprising:

a first cover covering a part of an internal combustion engine and provided with a first opening;

a second cover covering a remaining part of said engine and provided with a second opening adapted to be fit onto the first opening, said second cover being provided with a first seal surface extending substantially in parallel with a plane defined by said first and second openings along a peripheral part of said second opening and a second seal surface extending substantially perpendicularly with respect to said first seal surface from an inner periphery of said first seal surface toward said first cover; and a seal member including a first lip portion and a second lip portion, said seal member being attached along a peripheral part of said first opening of said first cover and adapted to engage both said first and second seal surfaces of said second cover, wherein said first lip portion is adapted to engage said first seal surface and deform inwardly thereby pressing said second lip portion to engage said second seal surface.

2. An engine cover arrangement according to claim 1, wherein said seal member comprises a retaining portion attached to an edge of said first cover, and an engagement portion extending from said retaining portion.

3. An engine cover arrangement according to claim 2, wherein said first lip portion and said second lip portion are both provided in said engagement portion.

4. An engine cover arrangement according to claim 1, further comprising an engine mount case, said second cover consisting of an under cover fixedly attached to said engine mount case while said first cover consists of an engine cover.

5. An engine cover arrangement according to claim 1, wherein said first and second covers are provided with mutually cooperating abutting parts which jointly define a closed state of said first and second covers.

6. An engine cover arrangement for an outboard marine drive, comprising:

a first cover covering a part of an internal combustion engine and provided with a first opening;

a second cover covering a remaining part of said engine and provided with a second opening adapted to be fit onto the first opening, said second cover being provided with a first seal surface extending substantially in parallel with a plane defined by said first and second openings along a peripheral part of said second opening and a second seal surface extending substantially perpendicularly with respect to said first seal surface from an inner periphery of said first seal surface toward said first cover; and a seal member at attached along a peripheral part of said first opening of said first cover and adapted to engage both said first and second seal surfaces of said second cover, wherein said seal member comprises a retaining portion having a substantially U-shaped cross section so as to fit onto an edge of said first cover, and an engagement portion extending from said retaining portion, wherein said seal member includes a first lip portion engaging said first seal surface and a second lip portion engaging said second seal surface, and wherein said first lip portion is provided in said engagement portion and said second lip portion is provided in an inner part of said retaining portion extending along said first cover in a direction substantially perpendicular to said first seal surface.

7. An engine cover arrangement for an outboard marine drive, comprising:

a first cover covering a part of an internal combustion engine and provided with a first opening;

a second cover covering a remaining part of said engine and provided with a second opening adapted to be fit onto the first opening, said second cover being provided with a first seal surface extending substantially in parallel with a plane defined by said first and second openings along a peripheral part of said second opening and a second seal surface extending substantially perpendicularly with respect to said first seal surface from an inner periphery of said first seal surface toward said first cover; and a seal member attached along a peripheral part of said first opening of said first cover and adapted to engage both said first and second seal surfaces of said second cover, wherein said seal member comprises a retaining portion attached to an edge of said first cover, and an engagement portion extending from said retaining portion, wherein said seal member includes a first lip portion engaging said first seal surface and a second lip portion engaging said second seal surface, wherein said first lip portion is provided in said engagement portion and said second lip portion is provided in said retaining portion, and wherein said seal member further includes a third lip portion which extends from said retaining portion next to said first lip portion, and is adapted to engage said second seal surface by being pressed by said first lip portion as said first lip portion engages said first seal surface and deforms inward as a result.

8. An engine cover arrangement according to claim 7, wherein said third lip portion is provided with a cross section having the shape of a laterally facing letter-V or chevron with a concave side facing said first lip portion, and said first lip portion is provided with an arcuate cross section with a concave surface facing said third lip portion.

9. An engine cover arrangement according to claim 8, wherein said third lip portion is additionally adapted to engage said first seal surface.

10. An engine cover arrangement for an outboard marine drive, comprising:

a first cover covering a part of an internal combustion engine and provided with a first opening;

a second cover covering a remaining part of said engine and provided with a second opening adapted to be fit onto the first opening, said second cover being provided with a first seal surface extending substantially in parallel with a plane defined by said first and second openings along a peripheral part of said second opening and a second seal surface extending substantially perpendicularly with respect to said first seal surface from an inner periphery of said first seal surface toward said first cover; and a seal member attached along a peripheral part of said first opening of said first cover and adapted to engage both said first and second seal surfaces of said second cover, wherein said seal member comprises a retaining portion attached to an edge of said first cover, and an engagement portion extending from said retaining portion, wherein said seal member includes a first lip portion engaging said first seal surface and a second lip portion engaging said second seal surface, wherein said first lip portion and said second lip portion are both provided in said engagement portion, and wherein said first and second lip portions extend from said retaining portion one next to the other, and said second lip portion is adapted to engage said second seal surface by being pressed by said first lip portion as said first lip portion engages said first seal surface and deforms inward as a result.

11. An engine cover arrangement according to claim 10, wherein said second lip portion is provided with a cross section having the shape of a laterally facing letter-V or chevron with a concave side facing said first lip portion, and said first lip portion is provided with an arcuate cross section with a concave surface facing said second lip portion.

12. An engine cover arrangement according to claim 11, wherein said second lip portion is additionally adapted to engage said first seal surface.

13. An engine cover arrangement for an outboard marine drive, comprising:

a first cover covering a part of an internal combustion engine and provided with a first opening;

a second cover covering a remaining part of said engine and provide with a second opening adapted to be fit onto the first opening, said second cover being provided with a first seal surface extending substantially in parallel with a plane defined by said first and second openings along a peripheral part of said second opening and a second seal surface extending substantially perpendicularly with respect to said first seal surface from an inner periphery of said first seal surface toward said first cover; and a seal member attached along a peripheral part of said first opening of said first cover and adapted to engage both said first and second seal surfaces of said second cover, wherein said seal member includes a first lip portion engaging said first seal surface, and second and third lip portions both engaging said second seal surface, the second and third lip portions being spaced from each other in a direction substantially perpendicular to said first seal surface.

* * * * *